United States Patent [19]

Rosaia

[11] 4,277,212

[45] Jul. 7, 1981

[54] CONNECTOR INTERCONNECTING FREIGHT DEVICES

[75] Inventor: Albert H. Rosaia, North Patchogue, N.Y.

[73] Assignee: Peck & Hale, Inc., West Sayville, N.Y.

[21] Appl. No.: 21,424

[22] Filed: Mar. 16, 1979

[51] Int. Cl.[3] ..... B65D 21/02; B65D 25/20; B65J 1/22

[52] U.S. Cl. ..... 410/78; 24/287; 24/370; 410/69; 410/84

[58] Field of Search ..... 24/81 E, 263 B, 263 CA, 24/73 R; 410/77, 78, 79, 82, 83, 69, 84

[56] References Cited

U.S. PATENT DOCUMENTS

| | | | |
|---|---|---|---|
| 3,294,420 | 12/1966 | Martin | 280/415 B |
| 3,387,571 | 6/1968 | Matushek et al. | 410/82 |
| 3,683,463 | 8/1972 | Sieter et al. | 24/81 E |
| 3,752,511 | 8/1973 | Racy | 24/81 E |
| 3,753,272 | 8/1973 | Laidley | 24/81 E |
| 3,894,493 | 7/1975 | Strecker | 24/81 E |
| 3,973,684 | 8/1976 | DiMartino | 410/79 X |
| 4,082,052 | 4/1978 | Looks | 24/81 E X |
| 4,212,251 | 7/1980 | DiMartino | 410/78 X |

*Primary Examiner*—David M. Mitchell
*Assistant Examiner*—Howard Beltran
*Attorney, Agent, or Firm*—Pennie & Edmonds

[57] ABSTRACT

A connector for use in the securement of a first member, such as a cargo container, to a base support includes a base member, a post member extending from the base member in one direction and an attaching means for attaching the connector to the base support extending from the base member in the other direction. Restraining means provides vertical restraint to the container when the post member is positioned to extend into the opening of the web of the corner casting thereof and the container is restrained from movement in at least one horizontal direction. In one form, a restraining surface for the container is located on a cam pivotally mounted by the post member and in a second form, a restraining surface for the container is on the post member itself. The cam of the first form is pivotally mounted so that in response to lifting movement, the cam is rotated about its axis to act upon the web portion to impart a force horizontally whereby the container, in unloading, follows a path similar to that in loading. In the second form, a plunger, under a force of compression of a spring, acts on the web portion to provide a similar function.

29 Claims, 14 Drawing Figures

CONNECTOR INTERCONNECTING FREIGHT DEVICES

FIELD OF THE INVENTION

The present invention relates to a connector for use in a securement system for securing a member, such as a cargo container, used in the transport of cargo, to a base support which may be a second container in a vertical, stacked relation.

DESCRIPTION OF THE PRIOR ART

Containerization has become the watchword in the transport of cargo. Quite commonly, cargo to be transported is stowed within a container at a first location to remain within the container until it arrives at a final destination. The first location may be a factory or other point of debarkation and the cargo moves with that container to the final destination at which it is unloaded. The containers generally are of a standardized size and dimension. In this manner, the container may be removably secured in transit to the bed of either a truck or railway car, or the deck or hatch cover of a container carrying ship, by securement structure located for receipt of the container. Containers may also be stored at locations within the hold of the ship. Additionally, the container may be removably secured to another container in vertical, stacked relation by similar securement structure. The stacking of containers is typically employed during transport by container carrying ship. In this latter mode, the containers normally may be disposed in stacks comprising, for example, five, six or more containers depending upon their location within the container carrying ship; while, in the former mode, i.e., in a disposition on deck or on a hatch cover, each stack may be formed of as many as four containers.

The area of the base support, be it the bed of a truck or railway car, or the hold or deck location of a container carrying ship within which a container may be securingly accommodated, normally will be such to accommodate a single container, or two or possibly three containers, end-to-end. Particularly, according to standard, containers may be combined to have a total length approaching 60 ft. Most containers in use today are of lengths of approximately 20 ft. and 40 ft., respectively. Thus, it may be appreciated that a container of longer length may be securingly accommodated within an area which will also accommodate an assortment of two or three containers of shorter length.

Each container includes a rigid casting at each corner. The corner castings each have a web on each side, and an opening extending through each web which communicates with the inner recess defined by the casting. The opening within each web is dimensioned and configured to receive structural elements, such as the aforementioned securement structure for removably securing the container to any of the base supports heretofore described. In addition, the openings may accommodate coupling devices to locate the container laterally with respect to a container in an adjacent stack of containers and bracket members to immobilize the containers either directly or through the implementation of lashing between selected bracket members and the bed, deck or hold serving as the base support.

A problem in the removable securement of containers arises when more than one container is received end-to-end in an area adapted to receive a longer container or combinations thereof which may approach 40 ft. or 60 ft. in length. This problem resides in the manner of removably securing the containers to the base support, which may be in the form of a ship or vehicle deck or the like, or a second container in vertical, stacked relation with the container to be secured. In particular, problems arise in the manner of manipulation of the securement structure at the facing ends for restraining vertical movement of the containers once they are received.

Normally, the containers are located so that their facing ends are at about a spacing of 3 inches. Also, quite commonly, each container is closely spaced along its length to another container or containers thereby to form a group of containers or a group of stacks of containers. While one group of containers may be more widely spaced from other groups of containers to provide access to individual containers or groups thereof, the arrangement of the containers in each group nevertheless compounds the problem of removable securement of the containers, particularly at the inboard location of the ship.

The manner of transport of containers, particularly by container carrying ship, introduces a problem with regard to the need for restraining of movement of the container vertically with respect to a base support. As may be appreciated, containers during this manner of transit are subject to the movements of the container carrying ship. These movements in turn, subject the containers to toppling loads, i.e. moments about the axis of the container carrying ship commonly referred to as "rolling moments," which cause the containers to tend to topple from their stacked relationship. Therefore, it is necessary not only to removably secure the containers, but to maximize restraint of vertical movement of one container relative to its base support, which may be in the form of another container positioned below the container to be secured.

Several forms of releasable locking structures are illustrated in U.S. Pat. No. 3,752,511 to S. Racy; U.S. Pat. No. 3,753,272 to W. S. Laidley; and U.S. Pat. No. 3,894,493 to M. V. Strecker, which is assigned to the assignee of the present invention. Each of these locking structures may be used at one of the four corners in the securement of a container to a base support which may be a container thereunder. In general terms, the locking structures are used for this purpose by introducing an element into an opening (the upper opening) of a corner casting of a secured container and manipulating either the locking structure or the element itself relative to the corner casting to secure the locking structure to the corner casting. Once another container is moved into position over the secured container and an upward extending member of the locking structure is allowed to enter a lower opening of a corner casting, the last-mentioned container is then permitted to move into a position of rest on the locking structure. Thereafter, the extending member of the locking structure is manipulated relative to the locking structure to secure the last-mentioned container. The manipulation of the extending member, which may be carried out through the use of a handle or the equivalent, has been found to be difficult, particularly when operating within the limited space generally available on container carrying vehicles and ships as previously explained.

Another form of releasable locking structure is disclosed in U.S. Pat. No. 3,973,684 to J. M. DiMartino. The locking structure or connector disclosed in the DiMartino patent includes a base structure characterized as a "foot" depending from the lower surface of the base for securement of the base to a corner casting of a container, and a structure characterized as a "post" extending upwardly from the upper surface of the base. The foot is adapted for entry into a horizontal opening so as to extend through a recess in the corner casting of the lower container while the post is adapted for entry through a horizontal opening to a recess in the corner casting of the upper container. The DiMartino connector is a passive element wherein the post has one pair of opposed side walls which are perpendicular to the plane of the base and a second pair of connecting side walls which are canted with respect to that plane. One wall of the canted side is intended to function to guide the upper container to a position of rest on the base. Specifically, DiMartino defines the guiding wall as a ramp surface. The opposite wall of the post is described as one which functions to restrain vertical movement of the upper container with respect to the base. To this end, the surface of the opposite wall interacts with the web or surface of the corner casting.

According to the description in the DiMartino patent, the connector may be used at what is characterized as a "hard to reach" location. However, the connector does not provide an adequate measure of restraint against vertical movements, at least of an upper container, notwithstanding whether or not the container is simultaneously restrained against horizontal movement. I have invented a conector which effectively restrains a cargo container vertically when the container is restrained horizontally, while avoiding the disadvantages of prior art devices.

SUMMARY OF THE INVENTION

The connector of the present invention is adapted for use in a securement system to secure a member such as a cargo container to a base support or to a second container immediately therebelow in stacked arrangement thereby to immobilize the container and minimize racking or other damage which may be caused by loads in transit. The connector is specifically adapted for use in the securement system in the immobilization of a container at those locations which may be considered as "hard to reach," i.e., at the facing ends. The preferred system includes a pair of the present inventive connectors together with a pair of locking devices of the type disclosed in the above-described Strecker patent so as to create a geometric lock for the container. While the preferred system includes a pair of locking devices of the Strecker type, any suitable container locking device may be used in combination with the present connectors.

The connector comprises a base member and a post member which extends upwardly from the base member. The post member is preferably integral with the base member and is dimensioned and configured for removable entry into an inner recess in a corner casting of the container by movement into an opening in a horizontal web formed integral with the corner casting. The invention also includes attaching means, also preferably integral with the base, extending in a direction opposite to that of the post member for attaching the base member to a base support. For the purpose of the present description, "base support" may be considered to include collectively any surface upon which a cargo container may be positioned, such as the bed of a truck or railway car, deck, hatch cover, below deck locations of a container carrying ship, or another container upon which a container is received in stacked relation.

In one form of the invention, the post member includes a slot and carries a cam element supported within the slot pivotally on an axle for free rotation relative to the slot. The cam element is mounted on the post member for pivotal movement about the pivot axis. Preferably, for use with cargo containers, the pivot axis of the cam element is oriented to be generally parallel to the short side of the container when the connector is in locked position with the corner casting and the container is disposed in a rested and vertically restrained position.

The cam element has an outline on the functional side which conforms generally to the outline, in elevation, of the post member with the addition of a nose portion which provides a horizontal surface for restraining the container from vertical movements. The cam element, further, is of a width which facilitates free rotational motion relative to the walls of the post member which define the slot. When a container is received on the base support and the post member is positioned within the web opening of the corner casting, the cam element is in juxtaposition to the inner surface of the corner casting adjacent the opening through which the post member entered. More particularly, once the container has been located to the position of rest, the outer surface of the web of the corner casting will reside on the base member and the horizontal restraining surface of the nose portion of the cam element will restrict vertical movement of the container.

In a second form of the invention, the restraining surface is formed as a direct part of the post member and it cooperates in a similar fashion with the base member and web of the corner casting to secure the container in locked position.

Each form of the connector of the present invention is utilized in a securement system for securing a container to a base support. Preferably, two connectors of the present invention are secured to the base support to cooperate with the corner castings of the container at the end which faces another container and two locking devices of a known type are disposed to cooperate with the corner castings of the container at the opposite end. The locking devices are preferably of a type having an inclined surface defining a ramp for imparting a horizontal component of movement to the container during positioning of the container on a base support and capable also of cooperating with a corner casting of the container to restrain movement in both the vertical and horizontal directions when the container is so positioned. As noted previously, the preferred form of locking device is the locking device described in the aforementioned Strecker patent.

In unloading the container, i.e., removing it from the base support, it is necessary that it move in directions opposite the directions it moved during the loading procedure. However, in unloading a container which is locked in position by the connector of the present invention, horizontal movement is imparted by a cam element of the first embodiment of the connector and by a spring release member of the second embodiment of the connector. The spring release member of the second embodiment of the connector includes a plunger which is movable within a bore located below the restraining surface and a compression spring for exerting a force on the plunger to urge it outwardly of the bore.

The geometric lock is formed by the connectors of the present invention in combination with the other locking devices which restrain movement of the containers both horizontally and vertically. To this end, the other locking devices may very well restrain both vertical and horizontal movements of the container, as is the case with the Strecker locking devices; however, in accordance with the present invention, it is only necessary that the container be restrained from movement in at least one horizontal direction. Thus, the respective forms of connector of the present invention restrain vertical movements of the container when the container is restrained in at least one horizontal direction by the other locking devices. In the preferred structures, the necessary horizontal restraint will be in a direction parallel to the longer side of the cargo container.

Once the geometric lock is released by eliminating the horizontal restraint of the locking devices, the container may be unloaded. In this action, in the first connector embodiment, the corner casting will act on the restraining surface of the cam element, causing it to pivot about its axis of rotation. In a manner likened to the action of the spring release member of the second embodiment, the particular structure and pivotal arrangement of the cam element produces force moments which result in a force acting on the web within the opening of the corner casting in a generally horizontal direction. If the container is supported vertically, sufficient force exerted by either the spring release member or cam element will permit unloading release of the container.

BEST MODE FOR CARRYING OUT THE INVENTION

Figure 1A:
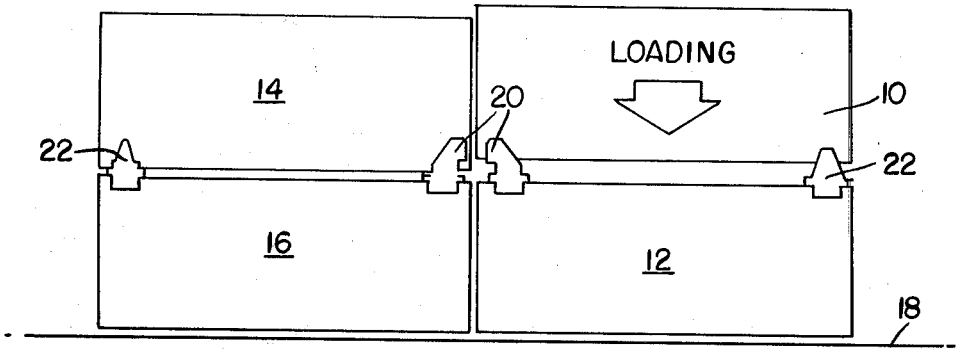
FIGS. 1A, 2A, and 3A illustrate schematically the general direction of movement in loading a container on a base support, the positioning of the container on the base support and the general direction of movement in unloading the container from the base support.
Figure 1B:
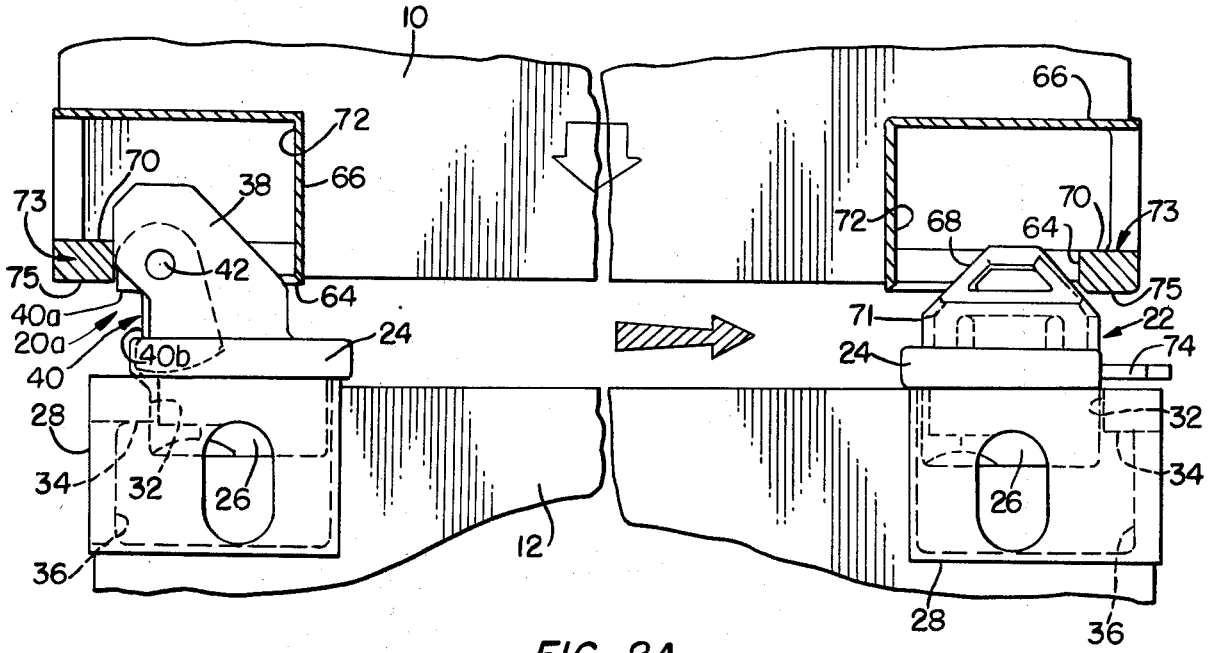
FIGS. 1B, 2B, and 3B are partial, enlarged views illustrating the operation of a new and improved connector adapted for use in the securement system of the present invention.
Figure 2A:
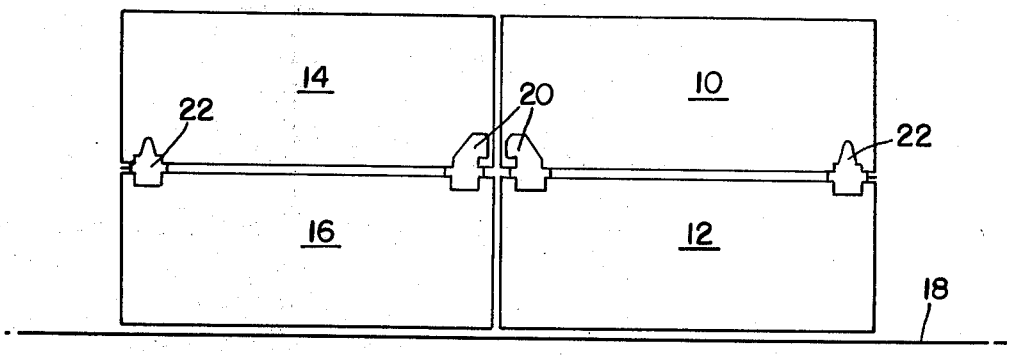
Figure 3A:
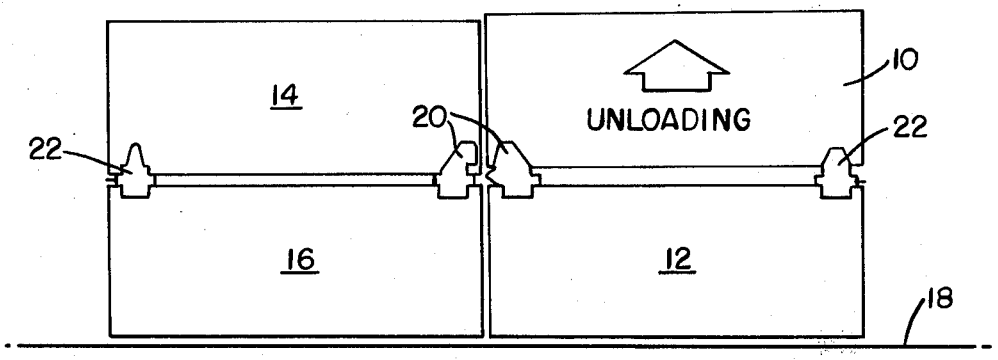

FIGS. 1A, 2A, and 3A illustrate a sequence of operation whereby a container 10 is moved to a position thereby to reside on a base support, such as a container 12, and then removed from the base support. In the figures, the containers 10 and 12 are illustrated as being grouped with containers 14 and 16 and possibly other containers (not shown) spaced along their lengths. In FIGS. 1A and 1B, as well as FIGS. 3A and 3B, descriptive terminology and directional arrows are included to illustrate the movement of the container, as previously described.

The containers in each level of containers, i.e., the containers 10 and 14 (and 12 and 16) are disposed in end-to-end relation and both stacked on and secured to the base support. Thus, the containers 12 and 16 provide a base support for the containers 10 and 14, respectively; while the base support for the former containers may be a bed 18, such as, for example, the deck of a container carrying ship. Securement of each container on the base support is preferably accomplished through implementation of connectors of the type illustrated at "20" in FIG. 1B, in combination with locking devices of the type also illustrated at "22" in that Figure. Such a securement system thereby provides a geometric lock in the restraint of each container both in the vertical and horizontal direction, once received on the base support. The connector 20 is used in the securement system at each of the corners of the container at the end facing a second container, and the locking device 22 is used at each of the other corners of the container. The preferred orientation of connectors 20 and locking devices 22 mounted on containers 12 and 16, respectively, are illustrated in FIGS. 1A, 2A, 3A, and 3B.

Figure 8:
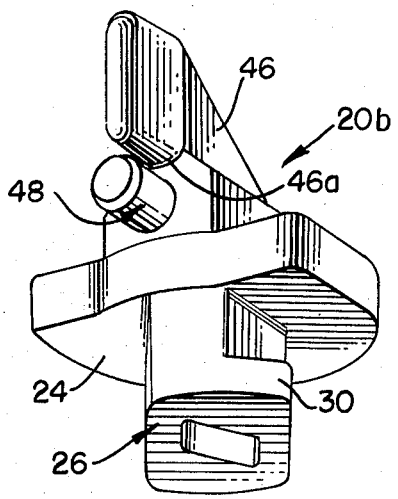
FIG. 8 is a view in perspective, as seen from below, of an alternate embodiment of the connector of the present invention.
Figure 9:
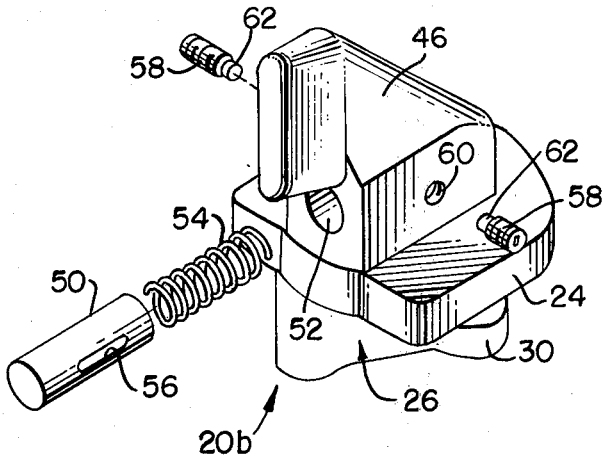
FIG. 9 is a view in perspective, as seen from above, of the connector of FIG. 8 with several components exploded therefrom.
Figure 10:
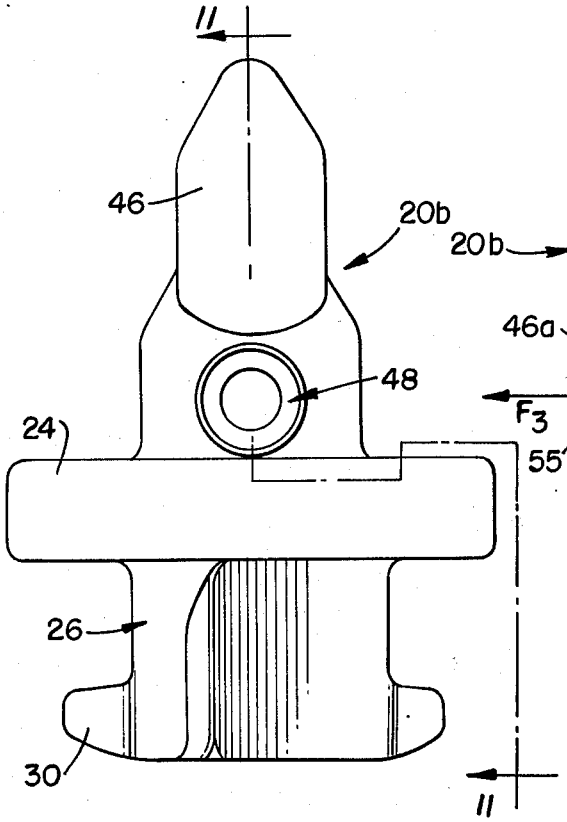
FIG. 10 is an enlarged front elevational view of the connector of FIG. 8.

The connector identified by the numeral "20" comprises the new and improved connector of the present invention. Two basic forms of the connector are illustrated, in perspective, in FIGS. 4 and 8, respectively. The connector of FIGS. 4 and 8 will, more particularly, be identified by the numeral with the suffix a and the suffix b, respectively; while, the connector generally illustrated in FIG. 1A, for example, will be identified by the numeral without suffix. The locking device 22 is preferably of any type having an inclined surface defining a ramp for imparting a horizontal component of movement to the container during the positioning of the container to the FIGS. 2A, 2B position and capable, also, of cooperating with a corner casting of the container to restrain movement in both the vertical and horizontal directions when the container is so positioned. As indicated, the locking device 22 may be of the type disclosed in the aforementioned Strecker patent. A locking device of that type has been used successfully in the securement system of this invention and is preferred.

Figure 2B:
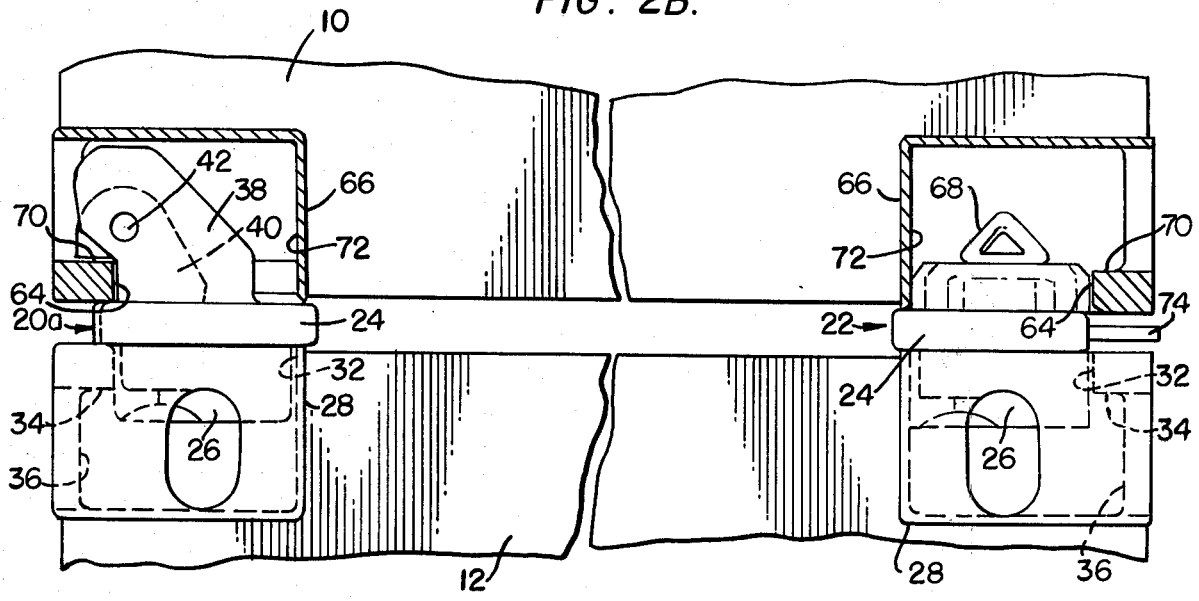
Figure 3B:
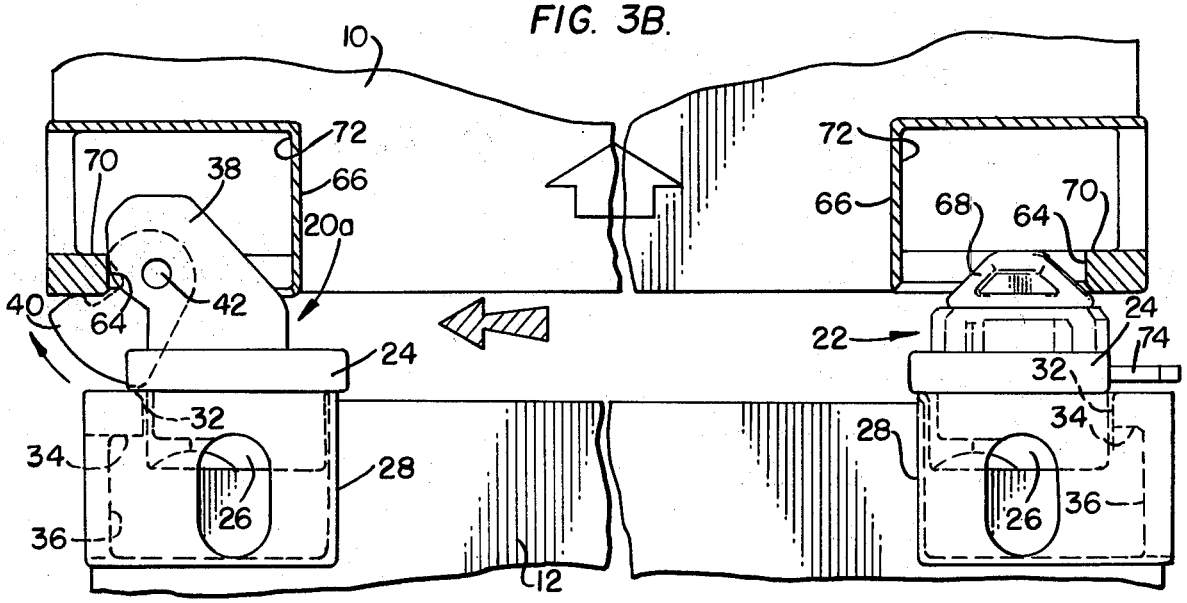

Connector 20 includes a base member 24 and an attaching means or foot 26 in the form of a twist base as shown, which depends from the base member. Referring specifically to FIGS. 1B, 2B, and 3B, the connector 20 and locking device 22 are mounted on, and secured to, respective corner castings 28 located at the corners of the container 12. The foot 26 for mounting and securing the base member may be as described in the aforementioned Strecker patent and that portion of the Strecker patent disclosure describing the foot as well as the disclosure describing the head construction and operation is incorporated herein by reference. In general, however, the foot may include a pair of opposed flanges 30 for entry into an upper opening 32 of each corner casting 28, yet when the connector is rotated to the position in FIGS. 1B, 2B, and 3B, the flanges engage the undersurface 34 of the corner casting within a recess 36. Thus, the connector is rigidly secured to the base member comprising a container. It is also contemplated that the connectors may be mounted on a base member comprising the bed 18. In this connection, the foot includes a plurality of lugs (not shown) for entry through a like plurality of slots in a socket (also not shown), such as disclosed in Strecker U.S. Pat. No. 3,860,209. Attention may be directed to that patent, also, and the disclosure pertaining to the rigid securement of the base member of the connector through rotational movement of the connector relative to the socket fixed on the bed. This portion of the last-mentioned Strecker patent is likewise incorporated herein by reference.

With specific reference to FIGS. 4–7, it may be seen that the connector **20*a*, in addition to the base member 24 and foot 26, includes a post member 38 and a cam 40. The post member extends upwardly of the base member and the cam is supported on pivot pin 42 supported by the walls of the post member which are spaced apart to define a slot 44**. The slot extends generally vertically of the base member within the region both of the base member and post member and the cam is movable relative to the slot.

Referring to FIGS. 8–11, the connector **20*b* likewise includes a base member 24 and a foot 26. In addition, a post member 46 is disposed on the base member and extends upwardly therefrom. This form of connector of the present invention further includes a spring release member 48 which provides a function similar to that of cam 40 of the first-mentioned form of connector in the unloading of a container, such as container 10** from the base support.

The spring release member includes a plunger 50 in the form of a cylindrical tubular member which is received in a bore 52. A compression spring 54 is supported between the end wall 53 of the bore and the closed end 55 of the plunger thereby to bias the plunger outwardly of the bore. A pair of openings 56 are formed in the plunger at diametrically opposite locations. The openings are of elongated oval outline and a pair of set screws 58, threaded in respective tapped bores 60, define the limits of movement of the plunger relative to the bore 52. To this end, each set screw includes an extension 62 of cylindrical outline and nonthreaded throughout a length substantially equal to the thickness of the plunger. The extension of each set screw enters into a respective opening for purposes of limiting movement and the extensions of opposed set screws serve as a track for movement of the plunger.

Figure 4:
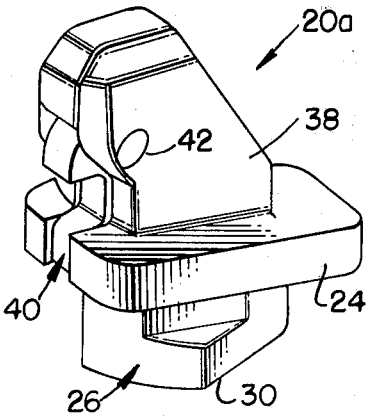
FIG. 4 is a perspective view of one form of the connector of the present invention.
Figure 5:
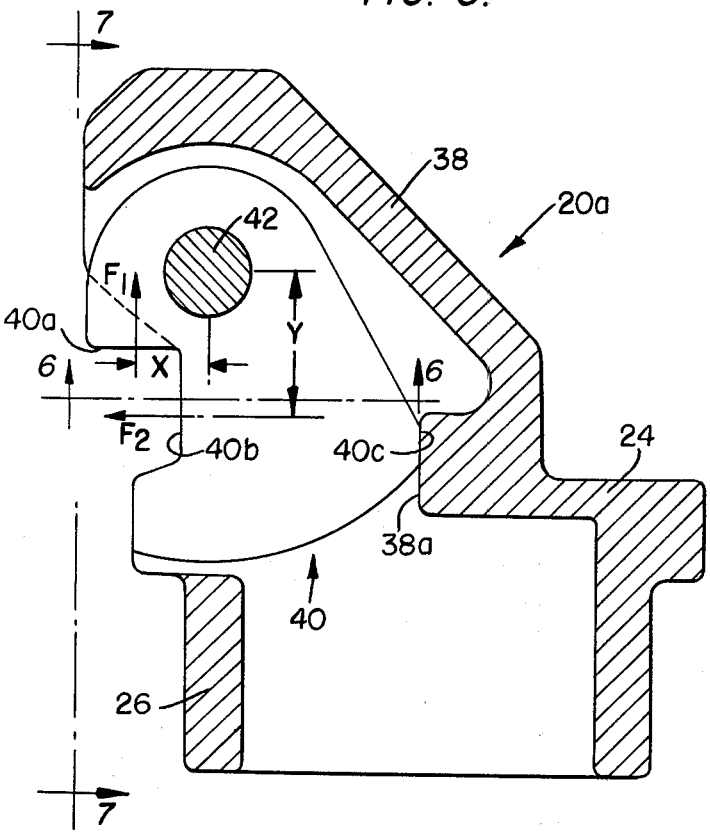
FIG. 5 is an enlarged view in elevation and partially in section of the connector of FIG. 4.
Figure 7:
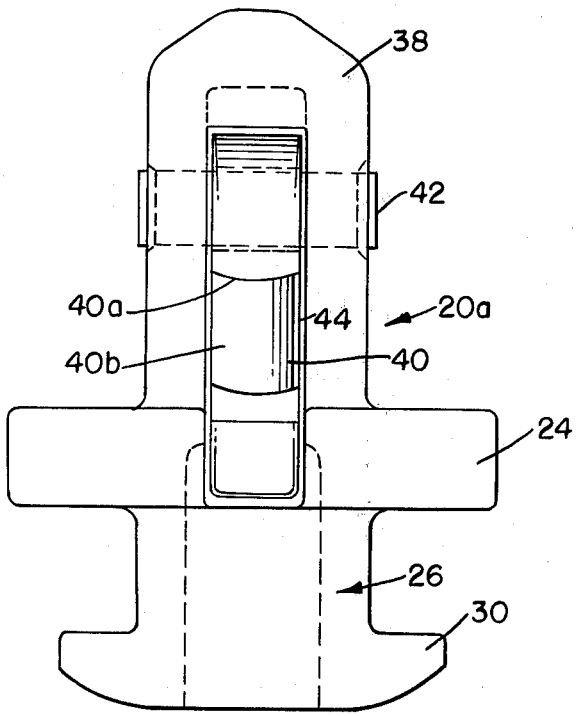
FIG. 7 is a view in front elevation of the connector as seen along the line 7—7 in FIG. 5.
Figure 6:
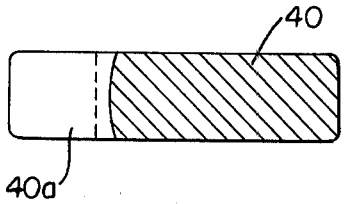
FIG. 6 is a view in section as seen along the line 6—6 in FIG. 5.
Figure 11:
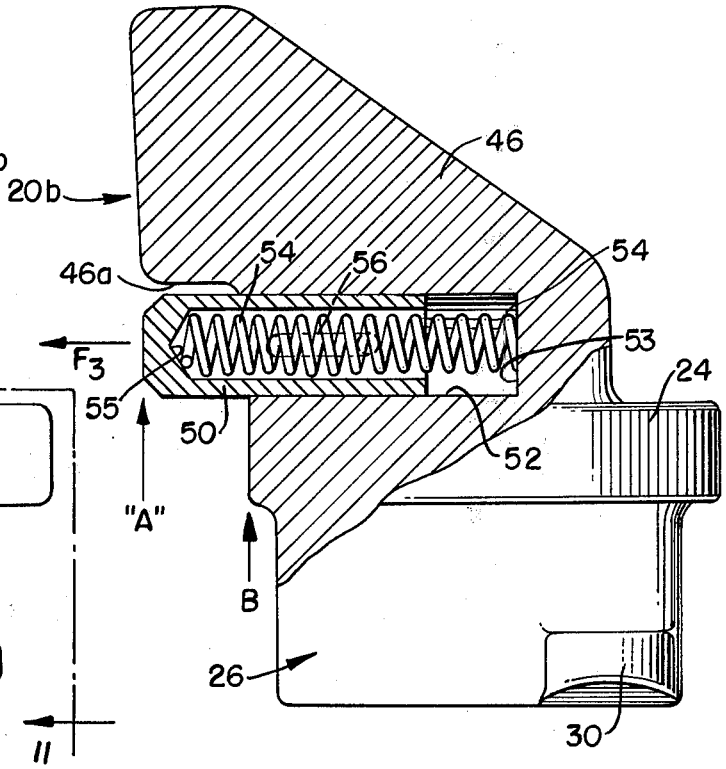
FIG. 11 is a view in section of the connector as seen along the line 11—11 in FIG. 10.

The cam 40 of connector **20*a* and plunger 50 of connector 20*b* are each capable of moving between a first or normal position as shown in FIG. 4 and at A in FIG. 11, respectively, and a second position through interaction surfaces within an opening 64 of the corner casting 66 during movement of a container toward the FIGS. 2A, 2B position. The second positions of cam 40 and plunger 50 are illustrated generally in FIG. 3B and at "B" in FIG. 11, respectively. And, as will be described, the cam and plunger each act on the surface of the opening to impart a force in the generally horizontal direction during unloading movement of the container away from the FIGS. 2A, 2B** position.

The connectors **20*a*, 20*b* are preferably formed of ductile steel, such as ASTM A 148-60 and, preferably, the base member 24, foot 26 and post member (38 and 46**) are cast as a single unit. The foot may be hollowed out thereby to reduce the overall weight of the connector. The connector is suitably galvanized for purposes of protection against the elements and, particularly, those encountered at sea.

In the securement of each container, such as container 10, on the base support thereby to provide the geometric lock, it is contemplated to employ a plurality of connectors 20 and locking devices 22. Thus, a pair of connectors 20 are mounted on and secured to the corner castings 28 of container 12 at the end facing the end of container 16 and a pair of locking devices 22 are mounted on and secured to the corner castings 28 of the same container although at the other end. As previously discussed, the mounting securement is carried out by rotating each connector relative to the corner casting after the foot 26, of each is received into the respective recesses 36. Thus, the flanges 30 are moved into engaging relation with the undersurface of the corner casting surrounding the openings 32 whereby the connector is positively and rigidly secured by the corner casting. In the position of securement, the connectors 20 and locking devices 22 will be oriented as illustrated in FIG. 1B, 2B and 3B.

In the stacking of any container, such as container 10, the container to be stacked is lowered toward the base support by means of a crane (not shown) or similar apparatus. To this end, container 10 will be lowered to a position relative to container 12 at which the ends of the post members, such as post members 38 of connectors **20*a* enter into the respective openings 64 of corner castings 66. The post members of connectors 20*a* which extend upwardly beyond the locking devices 22 at the other end of container 12, accordingly, serve as a means to locate container 10 to a position such that further vertical movement of the container will result in entry of a head 68 carried by each locking device 22 into the respective openings 64 of corner castings 66 at the other end. The post members 46 of connectors 20*b* provide a similar function and each of the post members, as well as the heads of the locking devices 22, preferably are provided with a chamfered edge to serve to more readily locate the container during a loading operation. Movement of container 10**, to this point during the loading operation, generally will be in the vertical direction.

The head 68 of locking device 22 includes a ramp surface which functions to impart a horizontal component of movement to the container so that it will follow an oblique path during a portion of its downward travel toward the position of rest illustrated in FIGS. 2A, 2B. Movement of the container will follow the oblique path as the corner casting 66 moves along the ramp surface. Thereafter, that end of the container will follow a short vertical path of movement to the position of rest. At this point, the head 68 may be rotated throughout an angle of about 90° (the position of the head from which and to which it is rotated is illustrated in FIGS. 1B and 2B). The head functions in a manner similar to that of the flanges 30 on foot 26 to cooperate or interfere with the inner surface 70 of the web 73 within the corner casting 66 at the other end to restrain vertical movement of the container at those corners. As stated in the Strecker '493 patent, the head 68 of locking device 22 is longer than the width of opening 64 of the corner casting to facilitate rotation of the head 68 to an interference position with web 73. A handle 74 is mounted by each locking device 22 for purposes of rotating the head. The portion of neck member 71 (positioned between the base member and the head) of locking device 22 disposed within the opening 64 restrains horizontal movement of the container.

The cam 40 of connector 20*a* is pivotally mounted so that in the first or normal position the cam will assume the position illustrated in FIGS. 1B and 4. Thus, the restraining surface 40*a* will reside generally parallel to the surface of the base member 24.

The sequential operation of a typical cargo container utilizing the connector 20*a* of the first embodiment will now be described in detail with reference to FIGS. 1B and 2B. Container 10 is lowered vertically downward toward container 12 until post member 38 of connector 20*a* enters partially, the opening 64 of corner casting 66 and outer surface 75 of web 73 contacts head 68 of locking device 22 to momentarily prevent further entry of locking device 22 into its respective corner casting 66. At this point, the container 10 assumes a counterclockwise tilting motion during which post member 38 of connector 20*a* enters fully the opening 64 of its respective corner casting 66 and outer surface 75 of web 73 rests upon the upper surface of base 24 of connector 20*a*. Immediately thereafter, the container 10 will follow an oblique path determined by the resumption of downward movement of outer surface 75 of web 73 along the ramp surface of head 68 of the respective locking device 22 until the web 73 assumes a rest position against base member 24 of the locking device 22. During this latter phase of movement, the container 10 shifts in a horizontal direction (as shown by the shaded arrow in FIG. 1B) and the web 73 defining opening 64 (and surrounding the post member 38 of connector 20*a*) moves into engagement with surface 40*b* of cam 40 and surface 40*c* engages surface 38*a* of post 38 to prevent further rotation of the cam 40. During this motion, the inner surface 70 of web 73 moves under restraining surface 40*a* of cam 40, thereby assuming an interference relation therewith so as to restrain upward movement of container 10.

Head 68 of connector 22 may then be rotated from the FIG. 1B position to the FIG. 2B position thereby restraining the right end of the container in movement vertically as well as horizontally by the head 68 acting within the recess in interference relation with the corresponding web 73. Horizontal restraint is provided for container 10 by neck 71 of locking device 22 positioned within the opening 64 of web 73 of corner casting 66. The connectors 20 and 22, then, will provide a geometric lock. It will be appreciated that upward movement of container 10 will be continued to be restrained by cam 40 as long as the container 10 is restrained against horizontal movement by locking device 22 within its respective corner casting 66.

If it is desired to unload the container 10 from the stacked position on container 12, handle 74 of each locking device 22 is first actuated to rotate each head 68 to return it from the FIG. 1B, 2B (locked) position to the FIG. 3B (unlocked) position. Accordingly, the restraint of vertical movement will be eliminated so that the container may be lifted upwardly by the crane. In the unloading position, it is necessary that the container move both vertically and horizontally to be released from connector 20*a*. In the unloading operation, a lifting force, identified as $F_1$ in FIG. 5, will act on surface 40*a* of cam 40 at a distance X from the axis of pivot pin 42. To this end, since the container 10 is able to move upwardly, the force will be imparted by the inner surface 70. Since cam 40 is pivotally mounted, force $F_1$ causes the cam 40 to rotate clockwise about its axis of rotation. Thus, as the container is lifted upwardly, the surface 40*b* of cam 40 will engage the surface within opening 64 of corner casting 66 with a resultant force, identified as $F_2$ identified as $F_2$ in FIG. 5, acting at a distance Y from the pivot axis of pivot pin 42. The force is sufficient to cause horizontal movement of the container 10 sufficient to release the container 10 from connector 20*a*. At release, the cam will return to the first or normal position.

By way of example and without any intent to limit the invention, it may be that during a container lifting operation the net upward force $F_1$ may be approximately equal to 4,000 lbs. acting at a distance of 1 unit from the axis of rotation of the cam, whereas the resultant horizontal force $F_2$ may act at a distance Y of 4 units from the same pivot axis. Accordingly, the resultant horizontal force $F_2$ will be approximately 1,000 lbs. and it has been found that a force of that magnitude is sufficient to release the container 10 in unloading it from container 12.

Action of a similar type follows from the operation of connector 20*b* of the second embodiment. The surface 46*a* functions in a manner similar to the function of surface 40*a* of connector 20*a* to provide an interference relation with web 73 thus providing vertical restraint for the container, when it becomes located to the position juxtaposed to the inner surface of the corner casting 66 adjacent the opening 64 through which the post member 46 entered. The geometric lock is completed upon manipulation of heads 68 of locking devices 22. When the vertical restraint provided by the heads 69 of locking devices 22 is removed, as previously described, the container 10 may be lifted (by a crane) in a direction away from the neck and the head 60 of locking device 22 so as to eliminate the horizontal restraint on the container. When the horizontal restraint is thus eliminated, a force, identified as $F_3$ in FIG. 11, which is exerted on the surface within the opening 64 of corner casting 66 by the plunger 50, through the action of spring 54, causes upper surface 70 of web 73 to shift out of the position of interference with web 73 to eliminate the vertical restraint of container 10. A force of the order of magnitude of the force supplied by cam 40 of connector 20*a* (as described in connection with FIGS. 1–3) may be exerted by spring 54 acting in compression on the plunger.

The operative components of the connector may be formed of any material having the strength and hardness capable of providing the operative functions, as described. Preferred materials include ductile iron, steel, aluminum and the like.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed:

1. A connector to secure a member to a base support disposed vertically therebelow, said member having at least one web portion defining an opening which communicates with an inner recess, comprising:

(a) a base;

(b) a post extending from said base and being dimensioned and configured for removable entry into said opening;

(c) means carried by said post to provide vertical restraint to said when said post is positioned to extend into the opening of the web portion and the member is restrained from movement in at least one horizontal direction, and for removal of said vertical restraint when said horizontal restraint is eliminated; and (d) means on said base for attaching said base to said base support.

2. The connector according to claim 1 wherein said base member defines an upper substantially planar surface portion upon which said web portion is supported, and said vertical restraint for said member is provided by a surface portion spaced from said upper surface portion of said base member.

3. The connector according to claim 1 wherein said base member includes an upper, substantially planar surface portion for supporting a web portion of the member.

4. The connector of claims 1 or 2 wherein said means for attaching said base member to said base support comprises a twist lock extending therefrom in a direction opposite said post member, said twist lock including at least one flange member dimensioned and configured to enter an opening in the base support in a first unlocked position and rotatable relative to the base support to a second locked position at which the dimensions of the flange member exceed the dimensions of the opening to place the flange member in interference relation therewith.

5. The connector according to claim 4 wherein said base support comprises an attachment fitting defining an opening and adapted to be secured to a deck.

6. The connector according to claim 4 wherein said member is in the form of a cargo container supported on a base support in the form of a second cargo container having corner castings, each having a web portion including an opening which communicates with a recess therein.

7. The connector according to claim 5 wherein said first and second members are cargo containers positioned in stacked relation and said web portion is part of a portion of a corner casting located at each of the corners of said container.

8. A connector to secure a member to a base support, said member having at least one web portion defining an opening which communicates with an inner recess, comprising:

(a) a base including an upper, substantially planar surface portion for supporting a web portion of the member;

(b) a post extending from said base and being dimensioned and configured for removable entry into said opening;

(c) a restraining element to provide vertical restraint to said member when said post is positioned to extend into the opening of the web portion, said restraining element having first and second surfaces, one of said surfaces being arranged to provide said vertical restraint for said member when said member is restrained from movement in at least one horizontal direction, said other of said surfaces being arranged to provide for removal of said vertical restraint when said horizontal restraint is eliminated; and (d) means on said base for attaching said base to said base support.

9. The connector according to claim 8 wherein said post member defines a slot having spaced apart wall portions extending generally perpendicular to said upper planar surface portion of said base member.

10. The connector according to claim 9 wherein said restraining element is a cam element mounted for pivotal movement within said slot of said post member.

11. The connector according to claim 10 wherein said post member extends upwardly from said base member and defines a surface portion which is canted relative to the upper surface portion of said base member.

12. The connector according to claim 11 wherein said first and second surfaces of said cam element are substantially perpendicular to each other.

13. The connector according to claim 12 wherein said first and second surfaces of said cam element are connected.

14. The connector according to claim 13 wherein said first surface of said cam element is substantially parallel to said upper surface portion of said base member when said post member is positioned in an upright orientation and said cam element is in a rest position.

15. The connector according to claim 14 wherein the member is a cargo container and said cam element is structured such that when the container to be secured is supported on said upper surface of said base member with said post member extending into the opening of a web of a corner casting, the web of the corner casting engages said second surface of said cam element thus restraining said cam element from pivotal movement in at least one direction and said first surface of said cam element provides upward vertical restraint for said supported member by assuming an interference relation with the web of the member when the member is restrained in a horizontal direction generally perpendicular to the pivotal axis of said cam element.

16. The connector according to claim 15 wherein said slot extends through a major portion of said post member to a location within the region of said base member.

17. The connector according to claim 16 wherein said cam element is positioned within said slot when said cargo container is supported on said base member and said post member is positioned within the opening of said web.

18. The connector according to claim 17 wherein said cam element moves pivotally out of said slot when said member is moved upwardly away from said base member and said base support.

19. A connector to secure a member to a base support, said member having at least one web portion defining an opening which communicates with an inner recess, comprising:

(a) a base including an upper, substantially planar surface portion for supporting a web portion of the member;

(b) a post extending from said base and being dimensioned and configured for removable entry into said opening, said post including a bore whose access extends substantially parallel to the plane of said upper surface portion of said base;

(c) means to provide vertical restraint to said member when said post is positioned to extend into the opening of the web portion and the member is restrained from movement in at least one horizontal direction, and for removal of said vertical restraint when said horizontal restraint is eliminated; and (d) means on said base for attaching said base to said base support.

20. The connector according to claim 11 further comprising means for releasing the member from vertical restraint including a generally cylindrical member, biasing means supported within said generally cylindrical member and acting within said bore of said generally cylindrical member and said post member to bias said generally cylindrical member in one direction to a position below said restraining surface portion, and means for limiting movement of said generally cylindrical member in said one direction, said release means acting in said one direction within said opening of said web portion when said supported member is moved vertically upward to thereby cause said supported member to shift horizontally as it moves vertically upward.

21. The connector according to claim 20 wherein said generally cylindrical member is a plunger.

22. The connector according to claim 21 further comprising means for limiting movements of said plunger.

23. The connector according to claim 22 wherein said means for limiting movements of said plunger comprises at least one opening extending throughout at least a portion of the length of said plunger, and means supported by said post member and positioned within each said opening for limiting movements of said plunger in both directions.

24. The connector according to claim 23 wherein said biasing means comprises a compression spring and said limiting means comprises at least one set screw, each said set screw having a rounded end which enters into a respective opening of said plunger.

25. A connector to secure a first member to one of a base support and a second member like said first member, said first member having at least one web portion defining an opening which communicates with an inner recess, comprising:

(a) a base member;

(b) a post member extending in a first direction from said base member and being dimensioned and configured for removable entry into said opening;

(c) means to provide vertical restraint to said first member when said post member is positioned within the opening of the web portion and the first member is restrained from movement in at least one horizontal direction, and for removal of said vertical restraint when said horizontal restraint is eliminated; and (d) means extending from said base member in a direction opposite said post member for attaching said base member to said one of said base support and second member.

26. A connector to secure a first member such as a cargo container having a three-sided casting at each corner to a second similar member disposed vertically therebelow, said first and second members having at least one web portion at each corner defining an opening which communicates with an inner recess defined by the casting, comprising:

(a) a base member;

(b) a post member extending upwardly from said base member and being dimensioned and configured for removable entry into said opening of said first member;

(c) means pivotally mounted on said post member and dimensioned and configured to provide vertical restraint to said first member when said post member is positioned within the opening of the web portion so as to extend into the recess when the web portion is supported on said base member, said pivotally mounted means including a surface portion spaced from said base member and dimensioned and configured to assume an interference relation with inner surface portions of said web portion of said first member when said first member is restrained from movement in at least one horizontal direction; and (d) means extending downwardly from said base member received within the opening of said web portion of said second member for attaching said base member to said second member.

27. A system for securing a first cargo container of the type having at each corner, at least one web portion defining an opening communicating with an inner recess to a base support comprising:

(a) a first pair of container locking devices positioned at at least two opposed corners, each locking device including:

(1) a base member;

(2) means extending downwardly from said base member for attaching said base member to said base support, and (3) means extending upwardly from said base member and dimensioned and configured for removable entry into an individual one of said openings so as to extend into each said inner recess as said first container is moved toward said base support so as to provide restraint for said container in at least one horizontal direction;

(4) means to lock said respective corner portions of said container to provide vertical restraint therefor; and (b) a second pair of connector members positioned at each of the opposed respective corners of the container, each connector member including:

(1) a base member;

(2) a post member extending from said base member and being dimensioned and configured for removable entry into said opening;

(3) means to provide vertical restraint to said first container when said post member is positioned to extend into the opening of the web portion and the first container is restrained from movement in at least one horizontal direction, and for removal of said vertical restraint when said horizontal restraint is eliminated; and (4) means on said base member for attaching said base member to such base support.

28. A system for securing a first cargo container to a base support, said container being of the type having at least a rectangular base and at each corner, a casting member defining three mutually perpendicular web portions, each defining an opening which communicates with an inner recess defined within the casting, comprising:

(a) a first pair of locking devices positioned at two adjacent container corners spaced apart from each other a distance approximately equal to the length of the shorter side of the container, each locking device including:

(1) a base member;

(2) neck means extending upwardly from the base member and dimensioned and configured for entry into the opening of the respective lower web portion of the respective container corner casting to thereby provide restraint to the container in horizontal directions;

(3) means for providing vertical restraint for the container castings;

(4) means extending downwardly from said base member for securing said base member to the base support; and (b) a second pair of connectors positioned at opposed respective corners of the container for providing a geometric lock for the container in combination with said locking devices, each connector including:

(1) a base member;

(2) a post member extending upwardly from said base member and being dimensioned and configured for removable entry into said opening;

(3) cam means pivotally mounted on said post member and dimensioned and configured to provide vertical restraint to said first container when said post member is positioned within the opening of the web portion so as to extend into the recess and the web portion is supported on said base member, said pivotally mounted means including a surface portion spaced from said base member for restraining engagement with inner surface portions of said web portion of said first container when said first container is restrained from movement in at least one horizontal direction; and (4) means extending downwardly from said base member for attaching said base member to said base support.

29. The system according to claim 28 wherein said cam means comprises a cam element defining two mutually perpendicular connected surfaces and being pivotally mounted such that the web portion of the corner casting of the first container to be secured may engage both surfaces when the first container is loaded and unloaded for securement and release, thereby causing said cam element to pivotally rotate about said pivot axis.

* * * * *